US005833171A

United States Patent [19]

Harris

[11] Patent Number: 5,833,171

[45] Date of Patent: Nov. 10, 1998

[54] WEB TENSION EQUALIZING ROLL AND TRACKING APPARATUS

[75] Inventor: J. C. Harris, Dale, Ind.

[73] Assignee: Equa-Liner Systems, L.L.C., Des Plaines, Ill.

[21] Appl. No.: 798,238

[22] Filed: Feb. 11, 1997

Related U.S. Application Data

[63] Continuation-in-part of Ser. No. 652,973, May 24, 1996, which is a continuation-in-part of Ser. No. 567,297, Dec. 5, 1995, Pat. No. 5,727,753.

[51] Int. Cl.[6] ..... B65H 23/025

[52] U.S. Cl. ..... 242/615.1; 242/615.2; 226/21; 226/194; 492/16

[58] Field of Search ..... 242/534.1, 563.1, 242/615.2, 615.1; 226/17, 18, 19, 21, 194, 191; 492/16

[56] References Cited

U.S. PATENT DOCUMENTS

| | | | |
|---|---|---|---|
| 850,892 | 4/1907 | Ball et al. . | |
| 2,476,070 | 7/1949 | Solliday | 242/534.1 |
| 3,055,083 | 9/1962 | Stobi . | |
| 3,224,757 | 12/1965 | Parke . | |
| 3,315,859 | 4/1967 | Owen, Jr. et al. | 226/194 |
| 3,489,264 | 1/1970 | Begiebing | 226/21 |
| 3,658,271 | 4/1972 | Austin . | |
| 3,831,876 | 8/1974 | Phelps . | |
| 4,109,976 | 8/1978 | Koch . | |
| 4,196,803 | 4/1980 | Lovett | 226/21 |
| 4,198,012 | 4/1980 | Esmande . | |
| 4,214,689 | 7/1980 | Bartel et al. | 226/21 |
| 4,235,002 | 11/1980 | Pav . | |
| 4,461,431 | 7/1984 | Wiley et al. . | |
| 4,551,203 | 11/1985 | Eskelinen . | |
| 4,641,770 | 2/1987 | Hediger | 226/21 |
| 4,809,445 | 3/1989 | Meyer . | |
| 4,893,740 | 1/1990 | Hediger et al. | 226/21 |
| 5,061,087 | 10/1991 | Roerig . | |
| 5,209,418 | 5/1993 | Alexander, III . | |
| 5,219,231 | 6/1993 | Sheedy . | |
| 5,224,790 | 7/1993 | Hein . | |
| 5,265,965 | 11/1993 | Harris . | |
| 5,339,534 | 8/1994 | Krayenhagen . | |
| 5,415,611 | 5/1995 | Krayenhagen | 492/16 |
| 5,419,509 | 5/1995 | Krayenhagen . | |
| 5,547,449 | 8/1996 | Krayenhagen . | |
| 5,730,693 | 3/1998 | Krayenhagen | 492/16 |
| 5,979,560 | 1/1998 | Cocker . | |

FOREIGN PATENT DOCUMENTS

| | | | |
|---|---|---|---|
| 2844528 | 4/1979 | Germany | 226/17 |

*Primary Examiner*—John M. Jillions
*Attorney, Agent, or Firm*—David W. Carrithers

[57] ABSTRACT

A rotating sleeve coaxially mounted upon an inner nonrotating pivoting sleeve by at least two rotary bearings on either side of a center mounted pivoting bearing assembly within the nonrotating pivoting sleeve supported by a stationary shaft. The nonrotating pivoting sleeve is balance-mounted in the center of the axis shaft with the pivoting bearing assembly. The pivoting bearing assembly permits a selected degree of lateral rotation in a range of from about 1 degree to about 10 degrees. As a web runs over the rotating sleeve any imbalance of lateral tension will cause the nonrotating pivoting sleeve to pivot at it's center with respect to the longitudinal axis of the shaft permitting the nonrotating pivoting sleeve and coaxial rotating sleeve to pivot upward on the side of least tension until the web tension is equalized across the coaxial rotating sleeve.

1 Claim, 15 Drawing Sheets

WEB TENSION EQUALIZING ROLL AND TRACKING APPARATUS

BACKGROUND OF THE INVENTION

This application is a Continuation-In-Part of U.S. patent application Ser. No. 08/652,973 filed on May 24, 1996 which is a Continuation-In-Part of U.S. patent application Ser. No. 08/567,297 filed on Dec. 5, 1995, now U.S. Pat. No. 5,727,753.

TECHNICAL FIELD

This invention relates to surface winding and unwinding of cloth, paper, metal, or plastic webs and the like from web rolls. The present invention utilizes an equalizing roll to be used in manufacturing for providing equal tension across a web, belt, or sheet of material during winding and conveying operations such as used in polymer film processing applications, corrugators, paper machines, printing presses, cloth winders, and metal winding operations.

BACKGROUND INFORMATION

The present invention comprises an equalizing roll which may be used as a stand alone unit or in a tracking apparatus for stabilizing the run of a material web which is being rolled off of or onto a drum or through a series of rollers. The present invention is designed to provide a method of optimally stabilizing, controlling the tension, controlling the slack, and the direction of a web, belt, or sheet of material while the web is traveling between rolls.

One application is in the drying section of a high speed paper machine where the paper web to be dried meanders over drying cylinders. The present equalizing roll is also useable in connection with a "transfer foil", i.e., a device for transferring the paper web from the press section to the drying section such as described in U.S. Pat. No. 4,551,203. The present invention may also be utilized for stabilizing and controlling the tension of a paper web of paper coaters. It is contemplated that the present invention can also be used in the fabric industry; plastics film, sheet, and tape industry; and in the metal film and foil industry. The invention may be used in small diameter, narrow width applications measurable in centimeters of inches or industrial operations wherein the rolls may extend thirty, fifty feet in length or longer depending on the application.

The equalizing roll of the present invention in the paper industry solves the problem of wrinkles and slack being formed in the paper or plastic film web during processing by an apparatus such as is described in U.S. Pat. No. 4,441,263. The present invention provides a means to control the pressure conditions in the area where the paper web runs together with a backing belt on a receiving drying cylinder and across the entire width of the paper web extending across the entire length of the drying cylinder or other such conveyor assembly. As is generally known, air flow transverse to the drying section causes the edges of the paper web to flutter and/or the formation of wrinkles in the paper web as shown in FIG. 1. This occasionally causes the paper web to break or a plastic web to be stretched and permanently distorted. A stable, smooth run of the paper web requires that the forces resulting from the longitudinal tension of the paper web being equal. The longitudinal tension on the paper web caused by the drying cylinder in combination with a backing belt creates a region in the paper web where the curvature is irregular as viewed across the width of the paper web. In the center, the paper web bows out more heavily than on the edges resulting in stretching and deformation of the web.

Another application for the present invention is in the cloth industry to avoid wrinkling cloth being unwound from rolls on surface winders and unwinders, batchers, cradle let-offs and the like. As set forth in U.S. Pat. No. 5,431,358, hereby incorporated by reference, in the area where the support rolls engage the cloth roll, the cloth roll is indented presenting a shorter cloth roll radius at that point than the radius in the unengaged areas of the roll resulting in the formation of a bulge or bagging down in advance of the support roll. Sometimes, the bulge or loose pucker resulting from such bagging down advances entirely about the wound roll causing wrinkling, marking and uneven tension.

U.S. Pat. Nos. 1,738,170, 3,433,429 and 4,026,487 illustrate efforts to solve the problem through compressible support roll coverings wherein an effort is made to match the compressibility of the support roll to the compressibility of the wound web roll. An inflatable support roll and other efforts to solve the problem include uniform or continuously spaced fluting on the support rolls. Such fluting may be skewed or spiralled in respect to the longitudinal axis. A roll having spaced segments is illustrated in U.S. Pat. No. 1,093,913, whereas U.S. Pat. No. 3,239,163 illustrates uniformly spaced compressible fluting having upper surface areas conforming to the curvature of the flexible roll. Attempts to match or otherwise utilize the relative compressibility of the support rolls in relation to the compressibility of the wound rolls have met with limited success. Fluted rolls having uniform circumferential spacing result in vibration or chattering and sometimes mark the wound rolls with the pattern of the fluted segments due to the limited areas of support.

The present invention provides an equalizing roll means to equalize the tension of the web as the web runs over the rolls distributing the lateral forces so that any imbalance of lateral tension will cause the roll to pivot at it's center permitting the roll to move upward on the side of least tension until the web tension is equalized across the entire roll.

SUMMARY OF THE INVENTION

The equalizing roller of the present invention is a universal mount idler roll that works off of a center pivot point and is able to swivel a selected amount preferably in a range of from about 0 to about 15 degrees. The equalizing roll is placed before or after, and in alignment with a plurality of idler rollers having a web roll or belt of material in order to maintain a constant tension of the web or sheet of material unrolling from a web roll to prevent stretching or wrinkling of the material and facilitating off rolling of the material in a straight line so that the sheet or ribbon does not want to veer to one side. Moreover, the tracking apparatus may be used in conventional conveyor assemblies to provide directional stability to a belt, sheet, or web of material being conveyed over at least one equalizing roll.

In one embodiment of the present invention, a common axis shaft is clamped rigid to support means preventing rotation. In some applications it may be desirable to support the shaft on two shaft support bearings to providing for rotation; however, oscillation may occur if the roll is not perfectly balanced or if the pivoting-rotary bearing has experienced wear making control of the roll difficult. Mounted in the center of the shaft is a self-aligning pivoting-rotary bearing assembly having an inner convex ball and an outer concave socket portion disposed within a housing sleeve. The single center pivoting-rotary bearing assembly is mounted inside a hollow cylinder or roll machined to be in balance with respect to the centrally disposed pivoting-rotary bearing assembly. The mating of the concave and convex portions of the pivoting-rotary bearing permits a selected degree of lateral rotation and allows the roll to rotate independent of the shaft. As the web runs over the roll, any imbalance of lateral tension will cause the roll to pivot at it's center permitting the roll to move upward on the side of least tension until the web tension is equalized across the entire roll.

More particularly, the present invention provides an equalizing roll for controlling web tension including a longitudinal shaft having distal ends rotatably supported by a pair of shaft support bearings, a self aligning center pivoting-rotary bearing assembly having an inner ball portion fixedly connected to the weighted center of the shaft and an outer socket portion fixedly connected to the weighted center of a cylindrical roll coaxially mounted around the shaft, wherein the deflection of the roll with respect to the shaft is in the range of from about one degree to about ten degrees, and most preferably about six degrees. A compressible pivoting-rotary bearing of selected rigidity may be utilized between the roll and shaft at one or more selected positions to limit or control oscillations of the roll with respect to the shaft.

Another alternate embodiment of the present invention provides for a double equalizing roll for use in high speed operations, such as printing, to minimize vibration and provide additional rotational stability. The double equalizing roll utilizes a stationary shaft mounted horizontally on clamped rigid supports preventing rotation. Mounted in the center of the axis shaft is a pivoting bearing assembly having convex and concave portions disposed within a pivoting sleeve. The pivoting bearing assembly is centrally mounted inside the sleeve formed from a hollow cylinder or roll machined to be in balance with respect to the centrally disposed bearing assembly. At least one pin extends upward from the shaft into a mating slot formed in the pivoting sleeve preventing rotation thereof. The mating of the concave and convex portions of the pivoting bearing permits a selected degree of lateral rotation in a range of from about 1 degree to about 10 degrees. The stationary shaft and pivoting sleeve is placed coaxially within a rotating sleeve having a greater diameter than the pivoting sleeve. The rotating sleeve is mounted upon at least two rotary bearings on either side of pivoting bearing assembly. As the web runs over the pivoting sleeve, any imbalance of lateral tension will cause the pivoting sleeve to pivot at it's center with respect to the longitudinal axis of the shaft permitting the pivoting sleeve to move upward on the side of least tension until the web tension is equalized across the pivoting sleeve while the exterior rotating sleeve rotates about the pivoting sleeve. The double equalizing roll provides a means for compensating to the tension and weight distribution of the web for high speed operations and minimize maintenance due to wear on the pivoting bearing assembly.

Accordingly, it is an important object of the present invention to provide a means for winding and unwinding paper, film, plastic, cloth or metal webs and avoid the problem of wrinkling, stretching, and marking of the web.

It is another object of the present invention to provide an equalizing roll to control the tension of a web to prevent the web from veering to one side.

It is another object of the present invention to provide an equalizing roll to control oscillation by use of a central pivoting means.

It is yet another object of the present invention to use a single pivoting-rotary bearing as a central pivoting means.

It is another object of the present invention to utilize the equalizer roll in tools such as with belt sanders or other equipment utilizing alignable belts.

Furthermore, the tracking assembly apparatus of the present invention comprises an equalizing roll, and an adjustable control arm assembly comprising at least one pair of pivoting arm assemblies. Each pivoting arm assembly includes a sensor arm linked to a steering arm by a means for pivoting. The sensor arm is in cooperative engagement with a web of material. The steering arm is in cooperative engagement with the equalizing roll. Whereby misalignment of the web of material moves the sensor arm pivotally linked to the steering arm exerting pressure on the equalizing roll correcting the alignment of the web of material.

It is another object of the present invention to utilize the equalizing roll in combination with an adjustable control arm assembly in cooperative engagement with an equalizer roll and the web of material to sense misalignment of the belt or web of material conveyed thereon and correct the alignment or tracking of the material by proportional adjustment of the equalizing roll.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

The equalizing roll and tracking assembly of the present invention is manufactured from readily available materials and simple in design. The preferred embodiment is comprised of metal, more particularly stainless steel, steel, or brass; however, it is contemplated that plastic or other polymer composite materials, such as graphite fiber, nylon, or even fiberglass, could be molded and used in combination with or substituted for the steel components of the present invention.

Equalizing Roll

Figure 1:
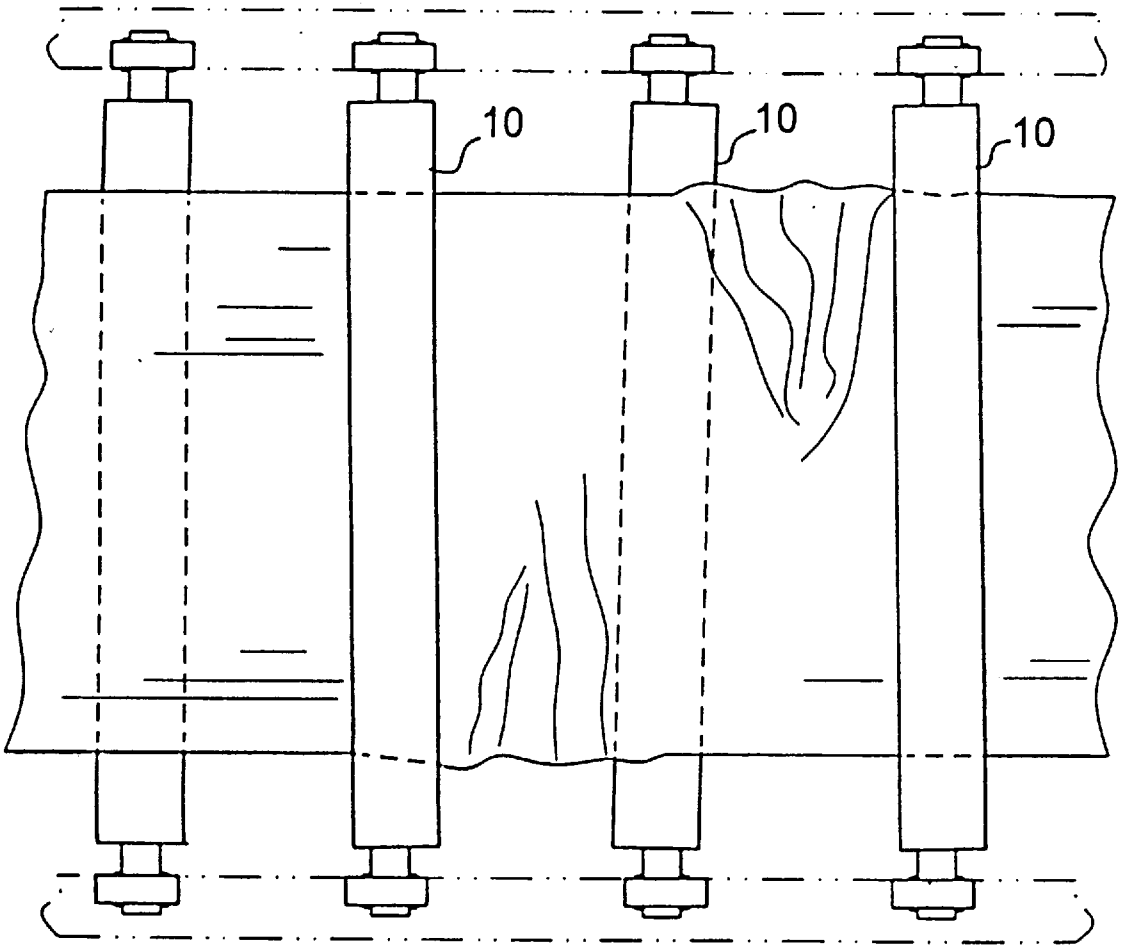
FIG. 1 is a top perspective view showing wrinkles formed in a web supported by a plurality of rollers.
Figure 2:
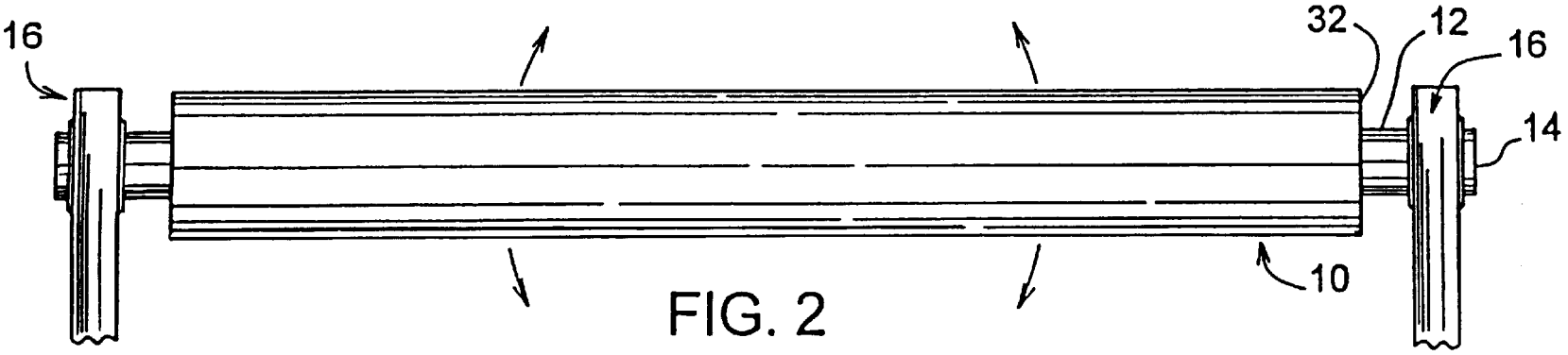
FIG. 2 is front view of the equalizing roll of the present invention showing the roll supported coaxially equal distance around a shaft supported by stationary support bearings.
Figure 3:
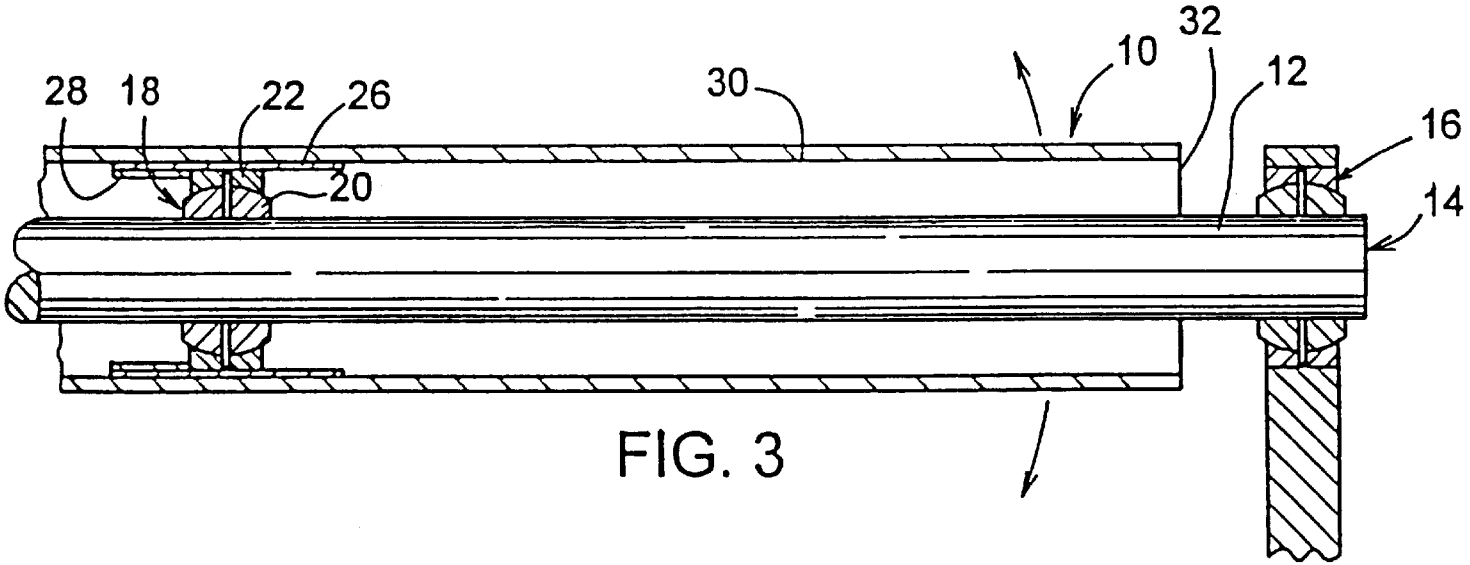
FIG. 3 is a partial cut-away view showing a central pivoting-rotary bearing assembly supporting the roll coaxially around the shaft wherein the roll is spaced equal distance from the surface of the shaft providing limited longitudinal movement of the roll around the shaft, and showing the shaft supported by a stationary end shaft support bearing.
Figure 4:
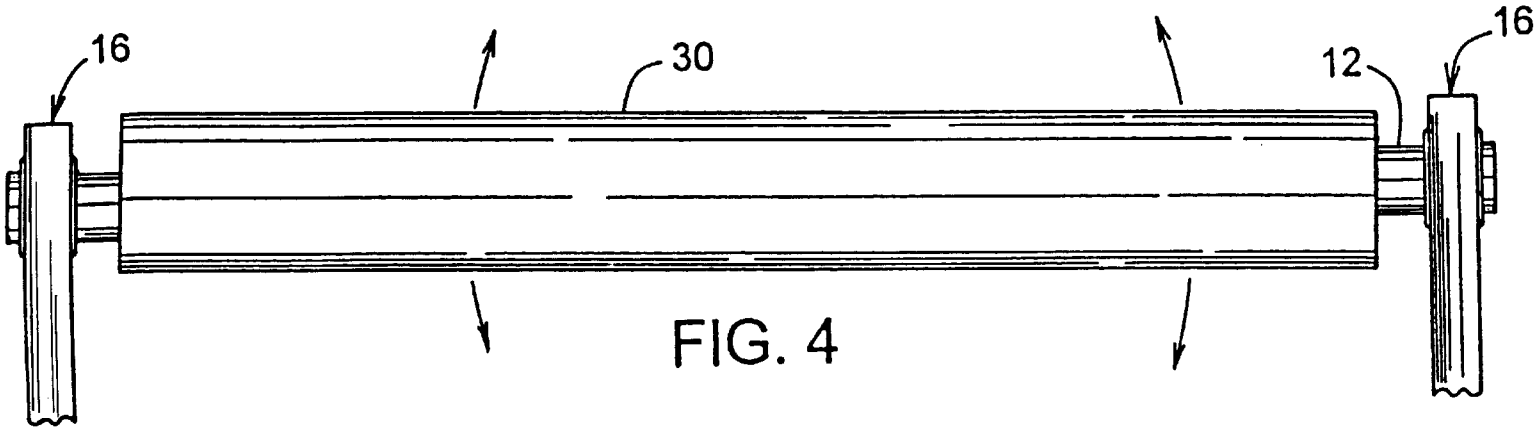
FIG. 4 is a front view showing the equalizing roll of FIG. 2, wherein application of tension to roll has caused the left end of the roll to raise upward nearer the bottom of the shaft and the right end of the roll to lower downward toward the top of the shaft.
Figure 5:
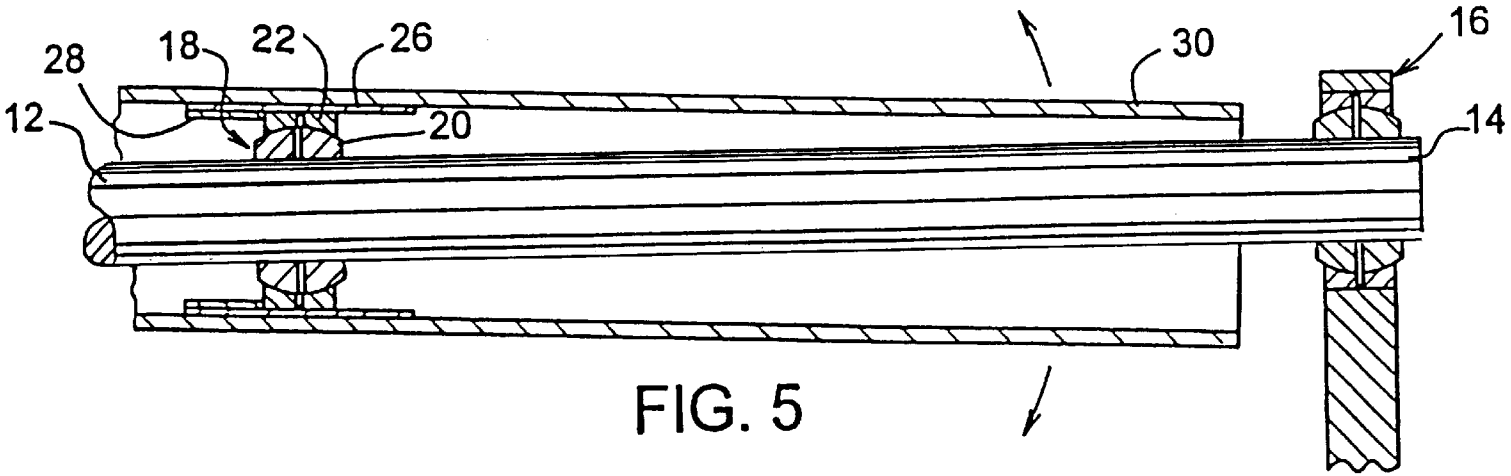
FIG. 5 is a partial cut-away view showing a central pivoting-rotary bearing assembly supporting the roll coaxially around the shaft wherein the distal ends of the roll are spaced an unequal distance from the surface of the shaft providing limited longitudinal movement of the roll around the shaft, and showing the shaft supported by a stationary end shaft support bearing.
Figure 6:
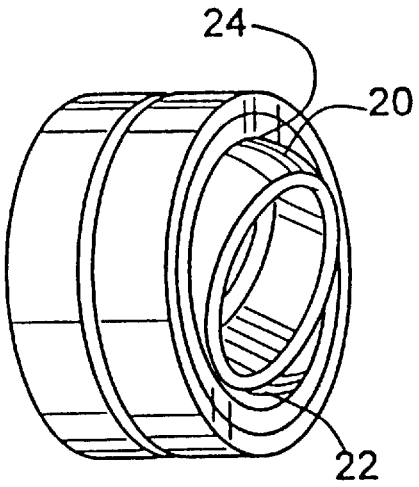
FIG. 6 shows a perspective view of the present invention showing a plain spherical roller pivoting-rotary bearing capable of pivoting upward, downward, back and forth and rotating such as is used for the center pivoting-rotary bearing assembly.
Figure 7:
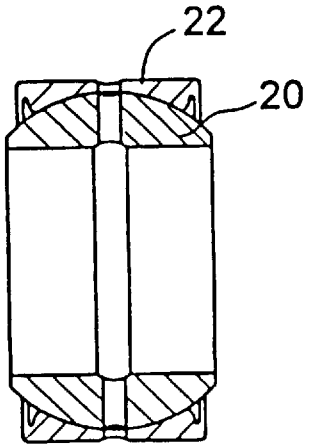
FIG. 7 is a cut-away view of the plain spherical roller pivoting-rotary bearing of FIG. 6, showing the degree of movement of the ball within the socket.
Figure 8:
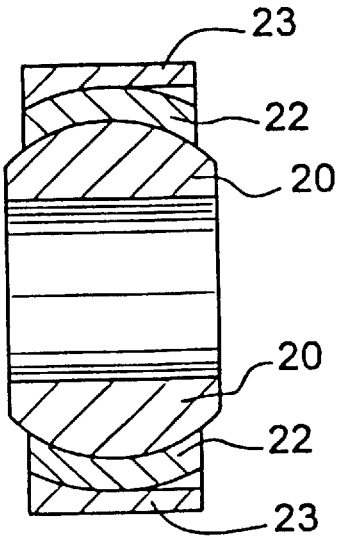
FIG. 8 is a radial cross section showing a pivoting-rotary bearing subassembly in a the mounting socket such as is used in the center pivoting-rotary bearing assembly of the present invention showing the ball, socket, and cap.
Figure 14:
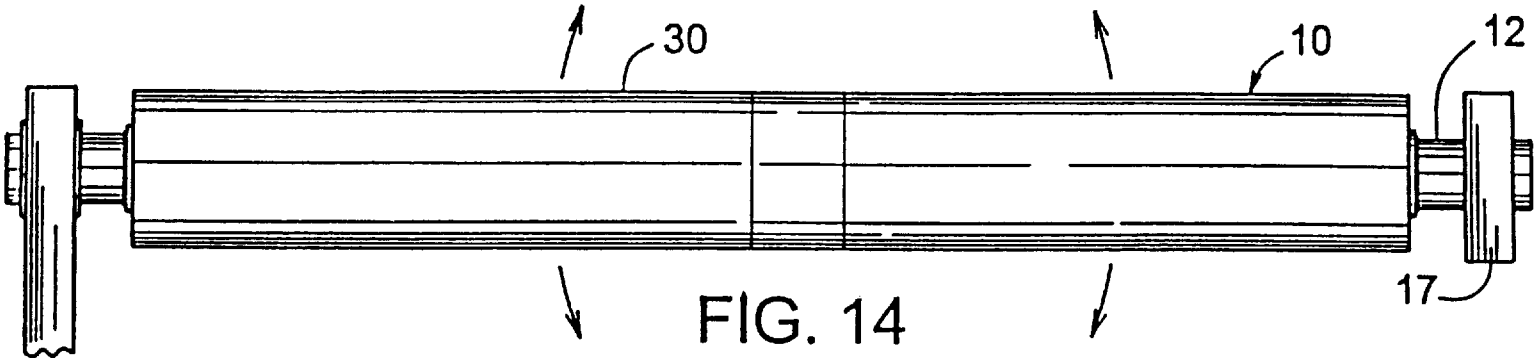
FIG. 14 is front view of the equalizing roll of FIG. 2, showing the roll supported by a shaft supported by a stationary shaft support bearing and rigid support member, and showing compressible bushing assemblies inserted within the roll coaxially around the shaft.

With reference to FIGS. 1–8, the equalizing roll 10 of the present invention utilizes an axle or longitudinal shaft 12 of a selected cross-sectional area having the distal ends 14 supported by stationary shaft support bearings assemblies 16, rigid support means 17 fixedly mounted as shown in FIG. 14, or a combination thereof. The shaft 12 is disposed through a center pivoting-rotary bearing assembly 18 comprising a spherical plain pivoting-rotary bearing such as shown in FIG. 8, a hog-ring pivoting-rotary bearing, a ball pivoting-rotary bearing, or a needle roller pivoting-rotary bearing in such a manner as to be positioned and balanced in the weighted center of the shaft 12. The center pivoting-rotary bearing 18 utilized in the equalizing roll 10 must provide for rotation as well as pivoting side to side oscillation and may be self aligning such as are commercially available from distributors. The equalizer roll 10 may be used in combination with a rotary Spherical plain pivoting-rotary bearings are further described in U.S. Pat. No. 5,265,965, hereby incorporated by reference, which are designed for application s where both misaligning and oscillatory motions are present. These self aligning pivoting-rotary bearings such as best shown in FIGS. 6–8 typically comprise a pivoting-rotary bearing assembly 18 having a inner convex portion having a spherical outer diameter referred to as the ball 20 fixedly connected to the shaft 12. The ball 20 is rotatably and swivelly mounted within an opening or socket 22 formed in a housing or cap 23 to form a ball and socket bearing. The socket 22 comprises an outer concave inner surface or raceway 24 that is integral and remains stationary with respect to the housing. The socket 22 inner raceway 24 and the outer spherical diameter of the ball 20 must have a very closely tolerance fit to assure consistent bearing performance and long life. U.S. Pat. No. 5,265,965 discloses several other ball and socket pivoting-rotary bearings in the references cited which may be usable in the present invention.

Another alternate embodiment of the present invention provides for a double equalizer roll utilizes a center pivoting bearing between a shaft and a pivoting sleeve and a pair of rotary bearings between the pivoting sleeve and an external rotating sleeve.

As shown in FIGS. 3, 5, 15, and 17, the equalizer roll 10 utilizing the pivoting-rotary bearing 18 is formed from a cylindrical sleeve or tube formed of metal such as steel or other material, such as a high durometer polymer such as teflon or graphite fiber, to form a roll or sleeve 26 connected to the exterior surface of the socket 22. In the preferred embodiment a spacer 28 is inserted into one end of the sleeve adjacent the cap 23 of the center pivoting-rotary bearing 18 for positioning the center pivoting-rotary bearing assembly 18 at the balancing point defining the weighted center of the equalizing roll 10. The exterior surface of the cap 23 is held immobile in the housing sleeve 26 which is fixed connected with the inner surface of a coaxial pivoting-rotating cylindrical roll 30 allowing the pivoting-rotary cylindrical roll 30 to rotate about the axis of the shaft 12 and for the distal ends 32 of the cylindrical rolls to be deflected according to the force applied by the tension of the web. FIG. 4 shows an end view of the equalizing roll 10 assembly.

An alternative method of insertion of the center pivoting-rotary bearing assembly 18 into the pivoting-rotary roll 30 and fixedly connected to the shaft 12 is to cut the cylindrical pivoting-rotary roll 30 into two sections for insertion of the center pivoting-rotary bearing assembly 18 and then using precision welding to weld the roll back together. Upon assembly the distal ends 32 of the cylindrical pivoting-rotary roll 30 may require drilling to remove weight, or welding to add weight to perfectly balance the pivoting-rotary roll 30 wherein the inner surface of the pivoting-rotary roll 30 is equal distant from the shaft 12.

During operation the equalizing roll 10 is loaded by outer force action along a tangent such as shown in FIGS. 4 and 5. The ball 20 may be deflected off center by as much as ten degrees depending upon the application and length and diameter of the coaxial pivoting-rotary roll 30; however, the preferred embodiment provides for about a six degrees of movement for controlling the tension of the web in paper processing applications. As the web runs over the pivoting-rotary roll 30, any imbalance of lateral tension will cause the pivoting-rotary roll 30 to pivot at it's center permitting the pivoting-rotary roll 30 to move upward on the side of least tension until the web tension is equalized across the entire pivoting-rotary roll 30.

Figure 9:
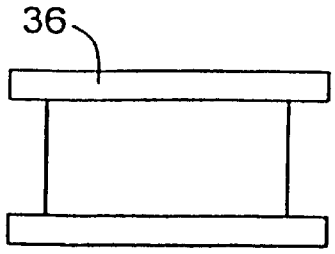
FIG. 9 is a top view showing the rigid bushing of the compressible bushing assembly which is mounted coaxially to around the shaft.
Figure 10:
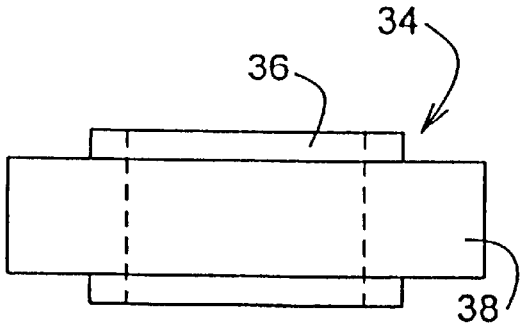
FIG. 10 is a top view showing a flexible outer bushing member mounted coaxially onto the rigid bushing of FIG. 9.
Figure 11:
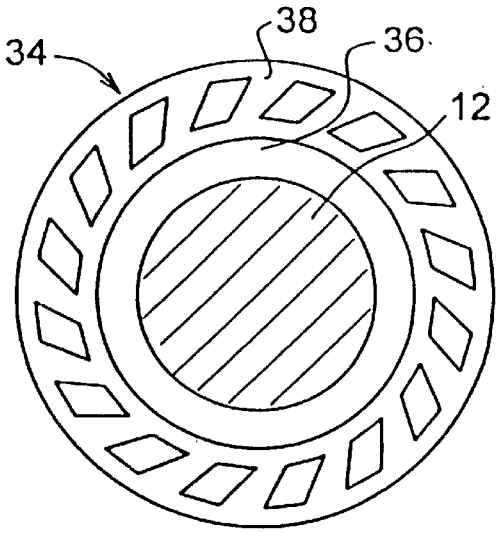
FIG. 11 is a side view showing the compressible bushing assembly of FIG. 10 mounted onto the shaft of the present invention showing unidirectional slots within the flexible outer bushing member.
Figure 12:
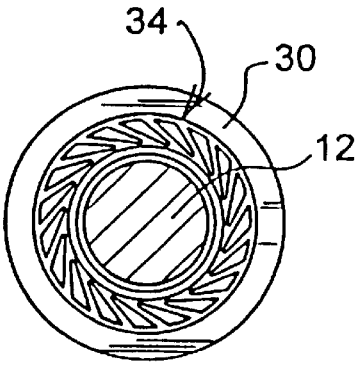
FIG. 12 is a side view of the equalizing roll of the present invention showing the compressible bushing mounted onto the shaft and the compressible bushing assembly being inserted into the roll.
Figure 13:
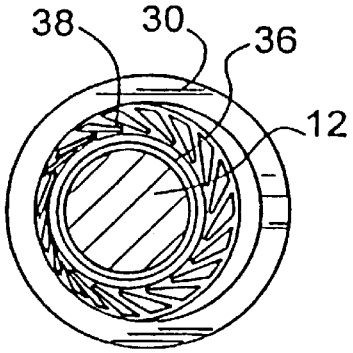
FIG. 13 is a side view of the bushing of FIG. 13, showing compression of the outer flexible bushing on one side.
Figure 19:
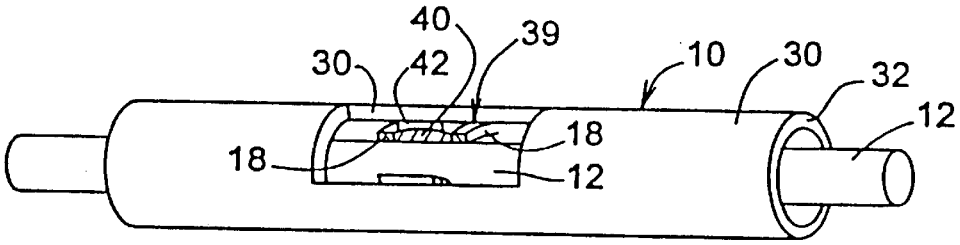
FIG. 19 is a perspective view of another embodiment of the present invention showing the roll supported by a center pivoting-rotary bearing assembly utilizing a pair of spacer members spaced apart from a pivot member and being positioned coaxially around the shaft.
Figure 20:
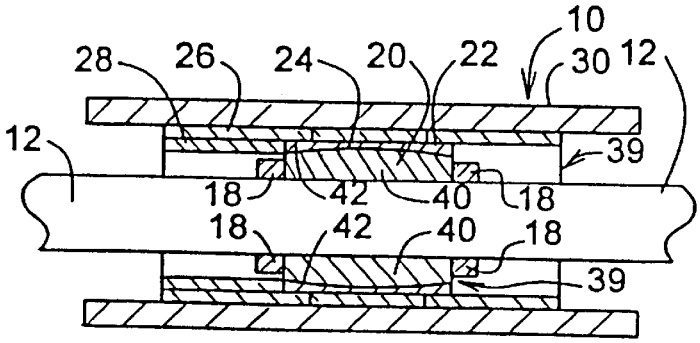
FIG. 20 is a partial cut-away view of FIG. 19 showing the roll supported by a center pivoting bearing assembly utilizing a pair of spacer members spaced apart from a pivot member and being positioned coaxially around the shaft.
Figure 21:
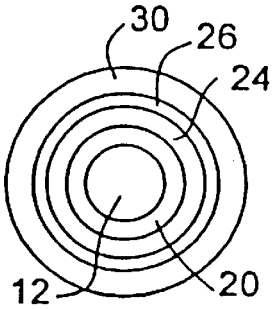
FIG. 21 is a side view of FIG. 20.

A compressible bushing assembly 34 as illustrated in FIGS. 10 and 11, consists of a generally rigid inner bushing 36 as shown in FIG. 9 which rotates coaxially around the shaft 12 together with a flexible outer bushing member 38 fixedly connected using by a friction fit with the interior surface of the pivoting-rotary roll 30. The compressible bushing 34 is inserted into selected positions within the pivoting rotary roll 30 coaxially mounted on the shaft 12 using at or near the distal ends of the roll. The compressible bushing assemblies 34 are not necessary for all applications, but are useful when a large amount of unequal tension is produced from a particular process operation. The compressible bushing 34 provides a means for allowing the pivoting-rotary roll 30 to move and oscillate, but to still bias the roll urging it to return to the center position to align the web and control the tension thereof. The inner bushing 36 are usually fabricated from teflon, carbon graphite, nylon, metal, or other tough self lubricating plastic material; however, it is contemplated that a lubricatable bushing can be used. The composition of the material selected for the inner bushing 36 is dependent upon the heat generated by the process or retained within the web material being conveyed. As shown in FIGS. 11–12 and 19 the flexible outer bushing member 38 is generally compressed of a flexible material such as an elastomer or other polymer such as PVC, polyethylene, or urethane, and including rubber and/or silicon compounds. The selection of the composition of the flexible outer bushing member 38 is determined by the heat exposure of the compound which is often as high as 400° F. and durability. The degree of hardness desired to provide the desired cushioning is selected depending upon the web strength and the amount of "play" which is acceptable due to the oscillation of the pivoting-rotary roll 30 around the shaft 12. The preferred embodiment utilizes flexible outer bushing 38 materials having a urometer hardness in a range of about 45 to 60, and more preferably about 50. The design of the slots within the flexible bushing member 38 and or the design of the thickness, radius, and/or curvature of the irregularities or projections on the outer surface of the flexible bushing member 38 provide another means to select and control the cushioning effect of the compressible bushing assembly 34.

Figure 15:
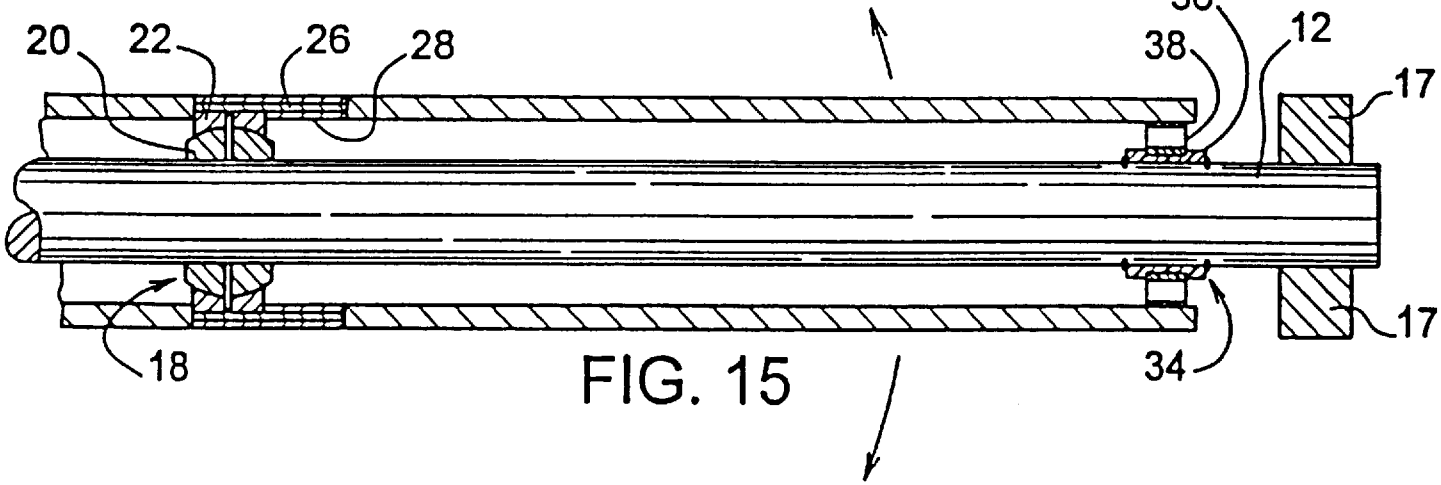
FIG. 15 is a partial cut-away view showing a central pivoting-rotary bearing assembly supporting the roll coaxially around the shaft as shown in FIG. 3, wherein the roll is spaced equal distance from the surface of the shaft providing limited longitudinal movement of the roll around the shaft, and showing the shaft supported by a stationary end shaft support bearing, and showing compressible bushing assemblies inserted within the roll coaxially around the shaft.
Figure 16:
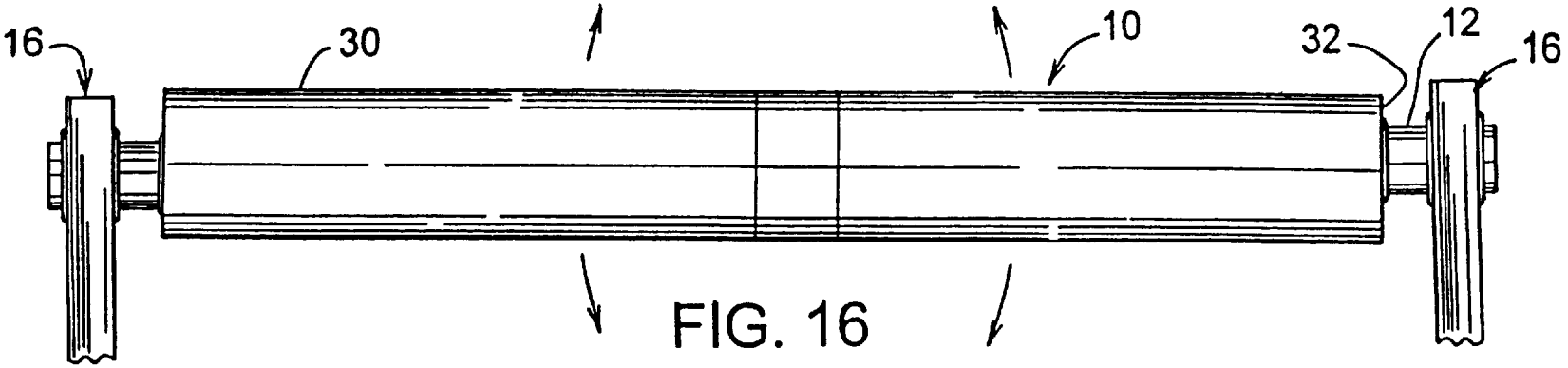
FIG. 16 is a front view showing the equalizing roll of FIG. 14, wherein application of tension to roll has caused the left end of the roll to raise upward nearer the bottom of the shaft and the right end of the roll to lower downward toward the top of the shaft and showing compression of the outer flexible bushing of the compressible bushing assemblies inserted within the roll coaxially around the shaft.
Figure 17:
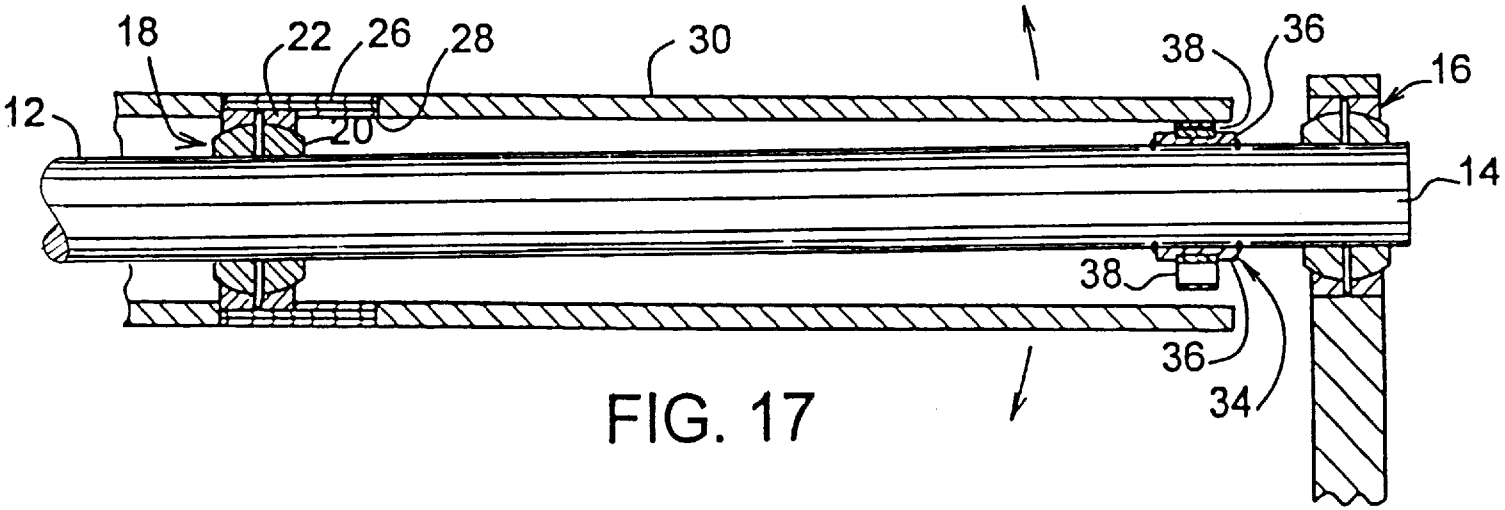
FIG. 17 is a partial cut-away view showing a central bearing assembly supporting the roll coaxially around the shaft wherein the distal ends of the roll are spaced an unequal distance from the surface of the shaft providing limited longitudinal movement of the roll around the shaft showing the shaft supported by a stationary end bearing, and showing compression of the outer flexible bushing of the compressible bushing assemblies inserted within the roll coaxially around the shaft.
Figure 18:
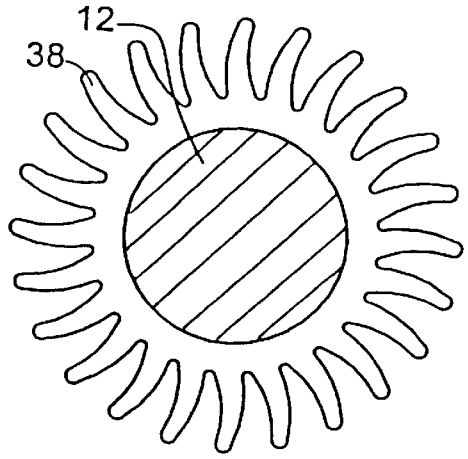
FIG. 18 is a side view showing another embodiment of a compressible bushing assembly.

FIGS. 14 and 15 shows the equalizing roll 10 supported by the shaft 12 which is supported by stationary shaft support bearings 16 and showing compressible bushing assemblies 34 inserted within the roll coaxially around the shaft. More particularly, the center pivoting-rotary bearing assembly 18 supporting the pivoting-rotary roll 30 coaxially around the shaft 12 shows the pivoting-rotary roll 30 is spaced equal distance from the surface of the shaft 12 providing limited longitudinal movement of the pivoting-rotary roll 30 around the shaft 12. The shaft 12 is supported by a pair of stationary shaft support end bearings 16. The compressible bushing assemblies 34 inserted within the pivoting-rotary roll 30 coaxially around the shaft 12 are shown in the compressed state in FIGS. 16 and 17, wherein application of tension to pivoting-rotary roll 30 has caused the left end of the pivoting-rotary roll 30 to raise upward nearer the bottom of the shaft 12 and the right end of the pivoting-rotary roll 30 to lower downward toward the top of the shaft 12 and showing compression of the outer flexible bushing 38 of the compressible bushing assemblies 34 inserted within the pivoting-rotary roll 30 coaxially around the shaft 12. As shown best in FIG. 17, a center pivoting-rotary bearing assembly 18 supporting the pivoting-rotary roll 30 coaxially around the shaft 12 has the distal ends of the pivoting-rotary roll 30 spaced an unequal distance from the surface of the shaft 12 providing limited longitudinal movement of the pivoting-rotary roll 30 around the shaft 12. The shaft 12 is shown supported by a pair of stationary end shaft support bearings 16, and the tension of the roll causes the compression of the outer flexible bushing 38 of the compressible bushing assemblies 34 inserted within the pivoting-rotary roll 30 coaxially around the shaft 12.

Figure 22:
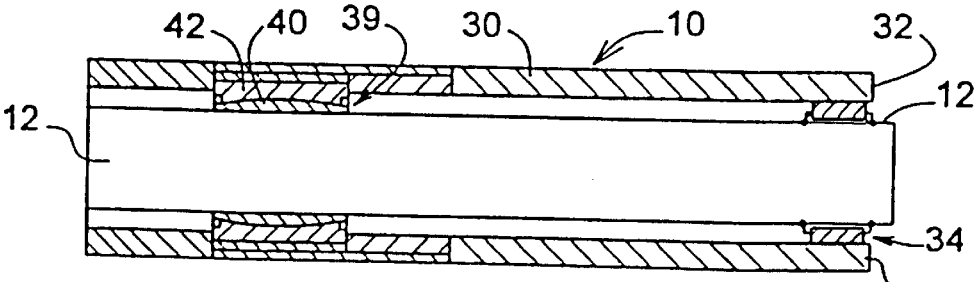
FIG. 22 is a longitudinal sectional view of FIG. 20.

As shown in FIGS. 19–22, an alternate embodiment of the present invention comprises a self-aligning pivoting bearing sleeve assembly 39 utilizing a pair of pivoting-rotary spherical bearing assemblies 18 centered and spaced apart from one another at a selected short distance whereby a convex sleeve member 40 has an inner surface fixedly attached coaxially around the shaft 12 in between the pivoting-rotary bearing assemblies 18. The convex sleeve member 40 cooperatively and rotatably engages a concave sleeve member 42 having an exterior surface fixedly attached to the inner surface of the pivoting-rotary roll 30, (or sleeve within the roll) providing a limited pivotal movement of the convex sleeve member 40 with the concave sleeve member 42. As shown in FIG. 22, compressible bushing assemblies 34 may also be utilized with the pivoting-rotary bearing sleeve assembly 39.

Tracking Assembly Apparatus

With reference to FIGS. 23–29, the tracking assembly 100 utilizes at least one equalizing roll 10 therein employing the aligning capabilities of the equalizing roll 10 in a unit together with an adjustable control arm assembly 102.

Figure 23:
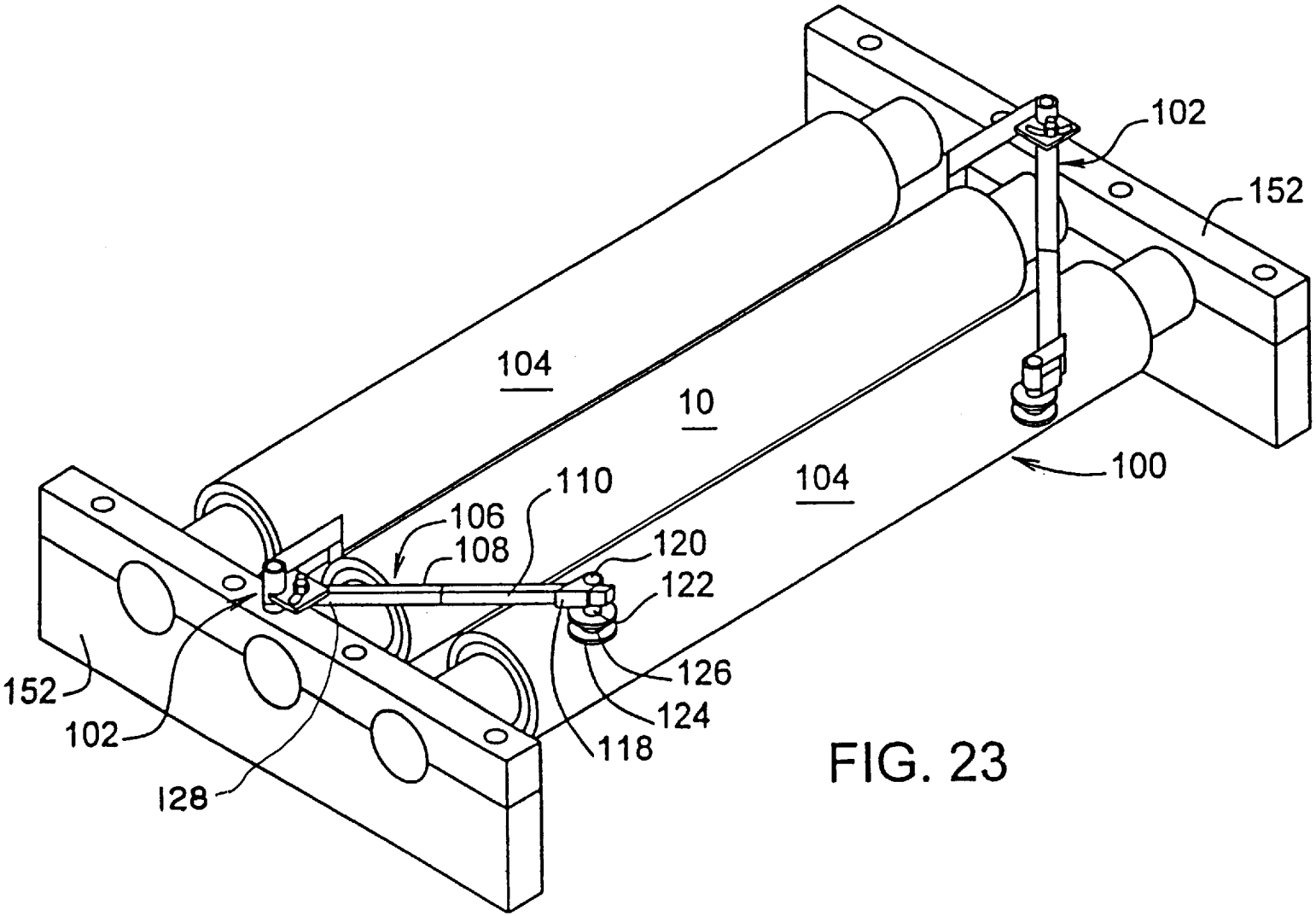
FIG. 23 is a perspective view of an equalizing roll tracking assembly apparatus showing the adjustment arm assembly having the steering arms in contact floating on the equalizing roll.

FIG. 23 shows a preferred embodiment of the tracking assembly 100 comprising an equalizing roll 10 mounted between a pair of idler rolls 104 spaced apart in alignment with one another. Of course, the spacing and alignment in the horizontal axis need not be equal depending upon the application.

The adjustable control arm assembly 102 of the tracking assembly 100 includes a sensor arm 106 which is adjustable. The sensor arm 106 may be a one piece member or it may define a telescoping first outer arm 108 slidably engaging a second inner arm 110. The sensor arm 106 may be formed having a particular shape on the distal end 112 in order to contact the side edge 114 of the web, sheet, or belt of material 116, shown best in FIG. 24, such as a "fork" shape. The preferred embodiment includes a sliding head 118. As shown in the illustrations, the sensor arm 106 is formed having a square cross-sectional areas; however, it is contemplated that the sensor arm 106 could be cylindrically shaped so that the head 118 could be rotated at an angle to optimize contact with the web or belt material 116. The sliding head 118 could also be used to contact the edge 114 of the material 116; however, the preferred embodiment utilizes a bar member 120 defining a spindle 122 having a rotating wheel 124 rotatably attached thereto. The bar member 120 may be utilized by itself and comprise a durable, low friction material such as TEFLON™, graphite or other hard polymer, or even metal. The wheel 124 of the preferred embodiment includes a groove 126 therein to assist in stabilizing and guiding the wheel 124 with respect to the edge 114 of the web material 116 being conveyed. The inner end 128 of the sensor arm 106 defines a "washer" or collar 130 having a hole therethrough for cooperative engagement and rotational "pivoting" movement with respect to a pin or bolt 134 secured to the means for mounting the equalizing roll 10. The preferred embodiment includes a flat plate 136 having a curved slot 138 therein for adjusting the angle of the sensor arm 106 with respect to the equalizer roll 10 and steering arm 140. Also, see FIG. 29. A pin or screw 142 extends upward through the curved slot 138 and is secured by a nut 144 in order to adjust the angle between the sensor arm 106 and steering arm 140.

The adjustable control arm assembly 102 of the tracking assembly 100 includes a steering arm 140 which is generally fixed, but may also be designed to be adjustable. The plate 136 is attached to the proximate end 146 of the steering arm 140 by a collar 148 which is rotatably supported by the bolt 134. As shown in FIGS. 23–28, the steering arm 140 is positioned above the sensor arm 106; however, the positions could be reversed. Also the plate 136 could be secured to the steering arm 140 so long as the pin and groove adjustment arrangement could be utilized. It should be noted that the operation of the control arm assembly is not dependent upon the angle of adjustment provided by the plate 136; however, the angle between the steering arm 140 and sensor arm 106 would have to be determined for particular applications and adjusted for different width belts or webs of material 116. A means for contact such as a contact block, roller, or other member 148 is connected to the distal end 150 of the steering arm 140. The contact block need not be of any particular shape; however, the surface should be smooth, tough, and durable because pressure will be exerted on the exterior surface of the equalizer roll 10 through the contact block 148 floating thereon in response to the movements of the steering arm 140 and sensor arm 106. A roller mechanism may be used as the contact block 148; however, a block of polymeric material such as graphite, nylon, or TEFLON™ may be utilized therefor. Preferably, the contact block 148 is adjustable in order to set the sensitivity of the "steering" action. As shown in the preferred embodiment the length of the sensor arm 106 is approximately three times the length of the steering arm providing about a 3:1 leverage ratio. In practice forces of least than one foot pound are sufficient to maintain alignment of the material; however, the force needed will vary with the type and weight of material. Of course, at least some correctional forces originate at the equalizer roll 10 and are transmitted through the steering arm 140 to the sensor arm 106 to the web of material 116 as well.

The steering arm 148 is positioned and sized so that the distal end 150 rests near or on the edge of the equalizer bar 10 to maximize the force thereon. The sensor arm 106 may be adjusted in length depending on the speed of the web, flexibility of the material 116, length of the web, distance of conveyance, etc. to determine the pressure to exert in order to maintain alignment of the material 116.

More than one equalizer roll 10 may be used in each tracking assembly 100. In addition, a plurality of tracking assemblies may be used in a conveyor system to maintain alignment of the material 16 conveyed thereby.

Figure 24:
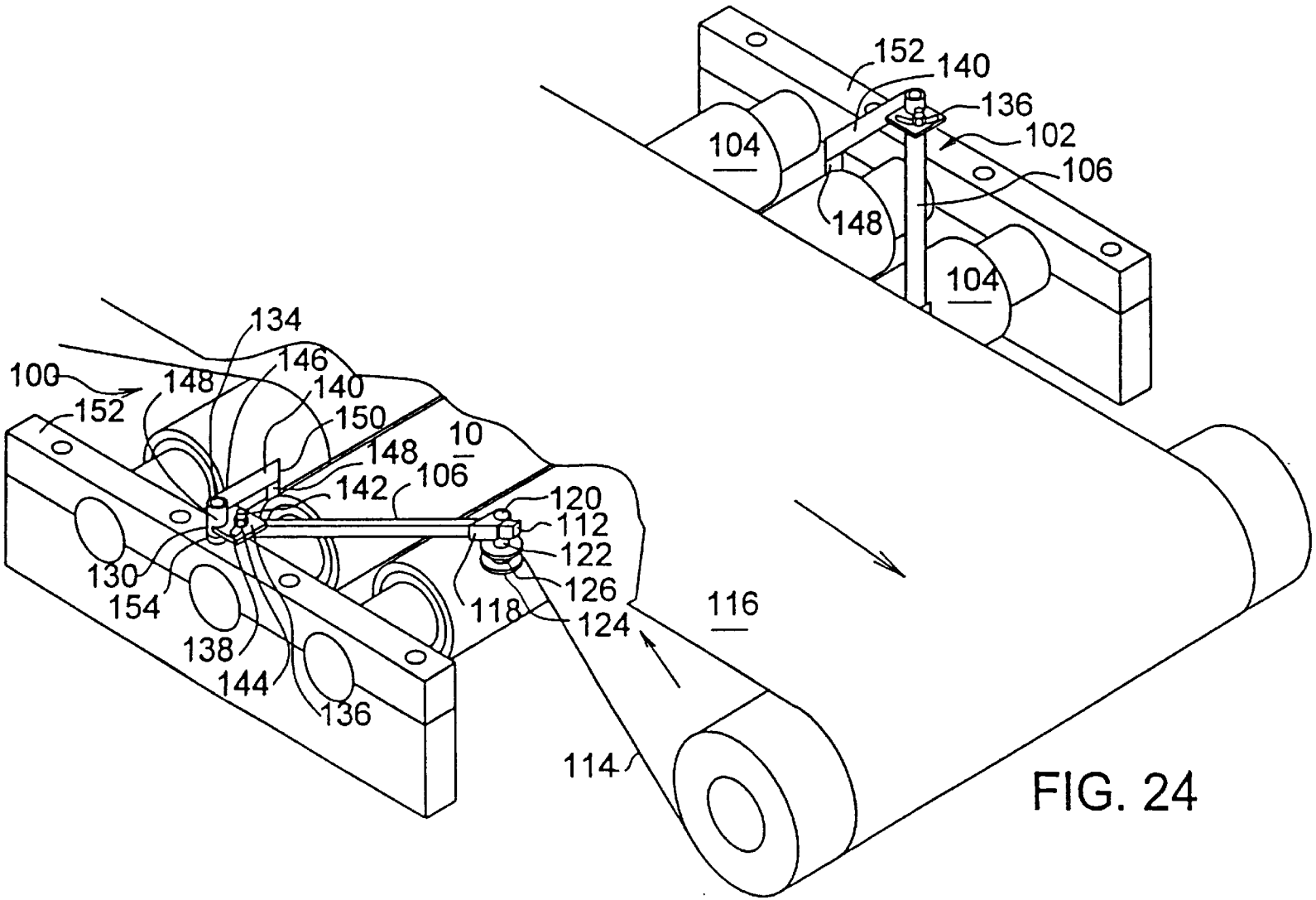
FIG. 24 is a perspective cutaway view showing the equalizing roll tracking assembly of FIG. 23 conveying a web or belt of material.
Figure 25:
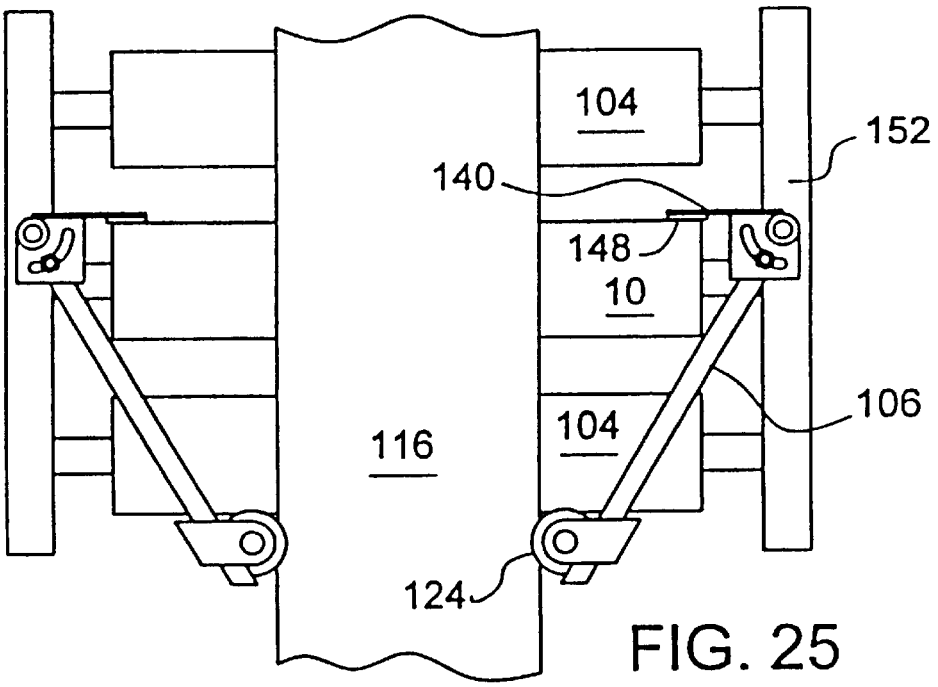
FIG. 25 is a top view of the equalizing roll tracking assembly of FIG. 23.
Figure 26:
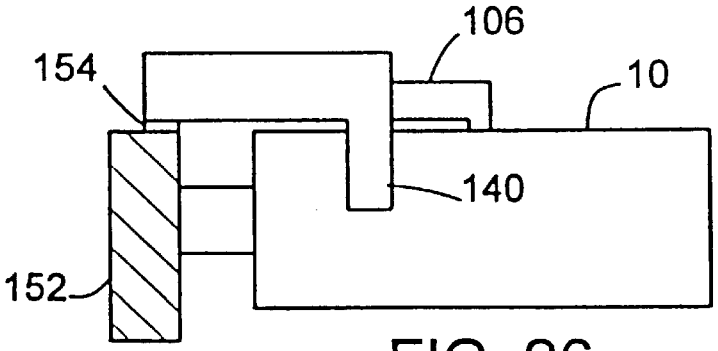
FIG. 26 is a rear view showing the equalizing roll and adjustable control arm assembly having the steering arm float on the surface of the equalizing roll.
Figure 27:
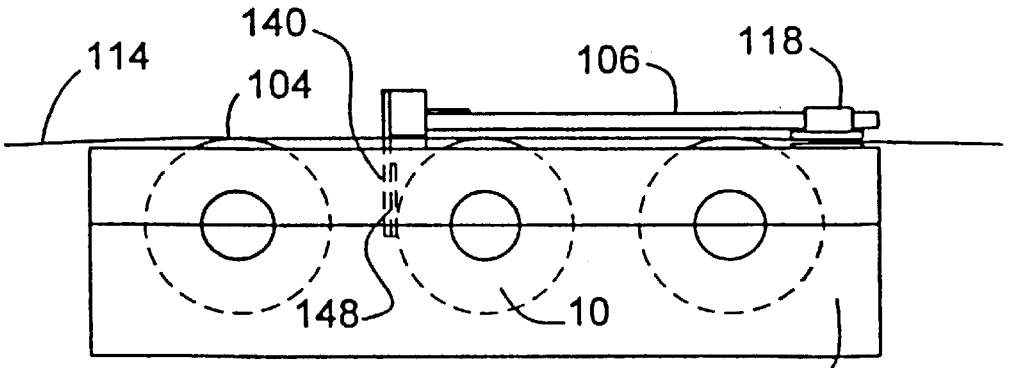
FIG. 27 is a side view of the equalizing roll tracking apparatus of FIG. 23.

FIG. 23–24 shows the tracking assembly 100 used in combination before a tail idler "tail pulley" because that is where the web of material usually tends to track off and out of alignment. As shown, in the tracking assembly 100, the web or belt of material is conveyed over and under at least one equalizer roll 10 and a plurality of conventional idler rollers 104 to decrease slack and maintain optimal control over the material 116.

As shown in FIGS. 23 and 24, the tracking assembly 100 consists of two permanently mounted idler rolls 104 straddling one equalizing roll 100, wherein all three rolls, 100, 104, and 104, share common mounting rails 152. Each rail 152 includes a mounting point pivot 154 for attachment of an adjustable control arm 102. The distal ends 112 of the sensor arms 106 are set to ride on the outer edges 114 of the material 116 to be tracked. When the web of material 116 moves to the left of right of center it contacts the sensor arm 106. The sensor arm 106 on the side contacted is pushed outward in relation to the web of material 116, causing the steering arm 140 to contact the equalizing roll 10. As the sensor arm 106 is moved outwardly, the steering arm 140 forces the equalizing roll 10 to pivot into an out of parallel condition. The "steering" of the equalizing roll 10 effectively counters the misalignment forces of the belt of material 116 causing it to track back into center alignment.

Figure 28:
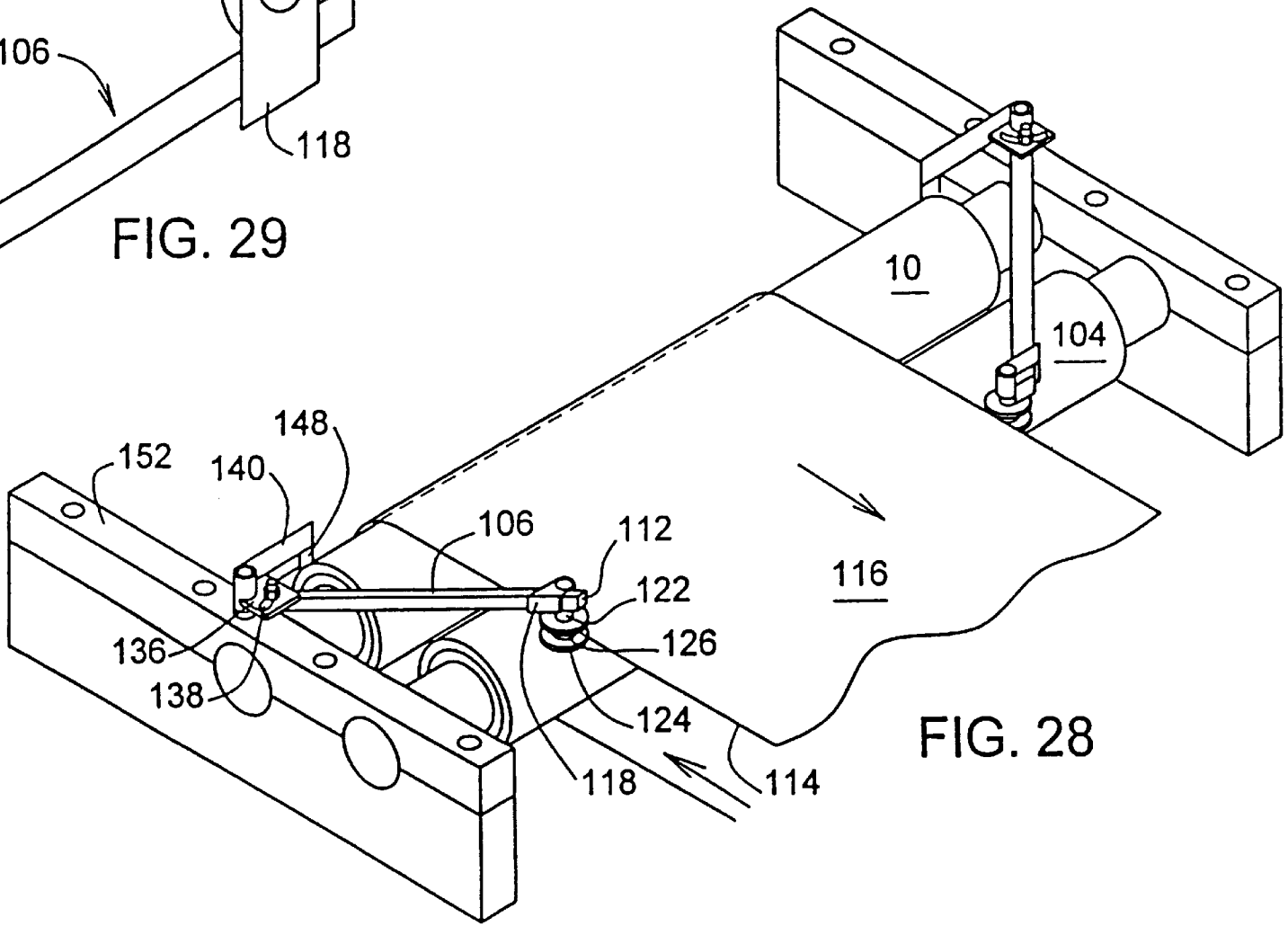
FIG. 28 is a perspective view of an equalizing roll tracking assembly wherein the equalizing roll provides an end pulley idler utilizing the adjustable control arm assembly to correct misalignment of a belt of web of material being conveyed thereon shown in phantom lines.
Figure 29:
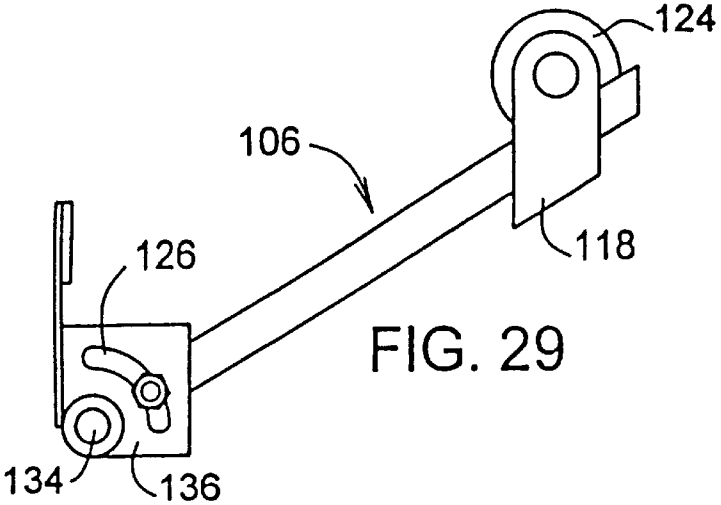
FIG. 29 is a top plan view of the sensor arm.
Figure 30:
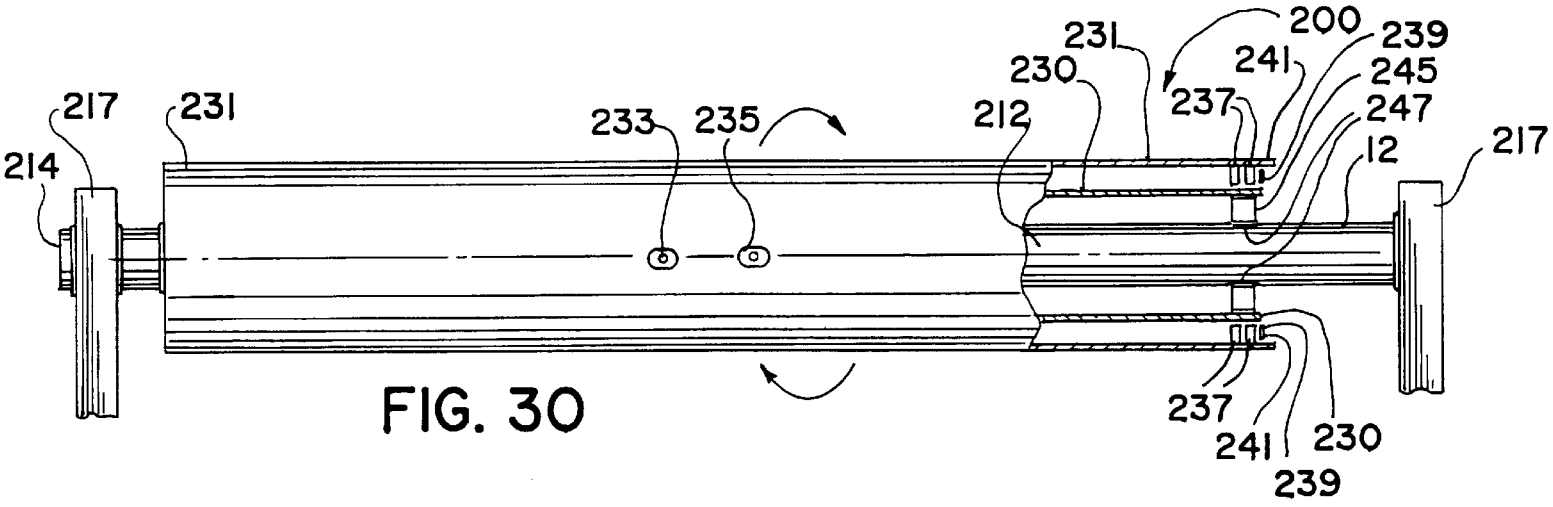
FIG. 30 is a front partial cutaway view showing the double equalizing roll showing the rotating sleeve supported by a pair of distal end rotary bearings extending coaxially around the nonrotating pivoting sleeve supported by a pivoting bearing and connected to the nonrotating shaft having a pliable distal end bushing extending around and between the shaft and the pivoting sleeve.
Figure 31:
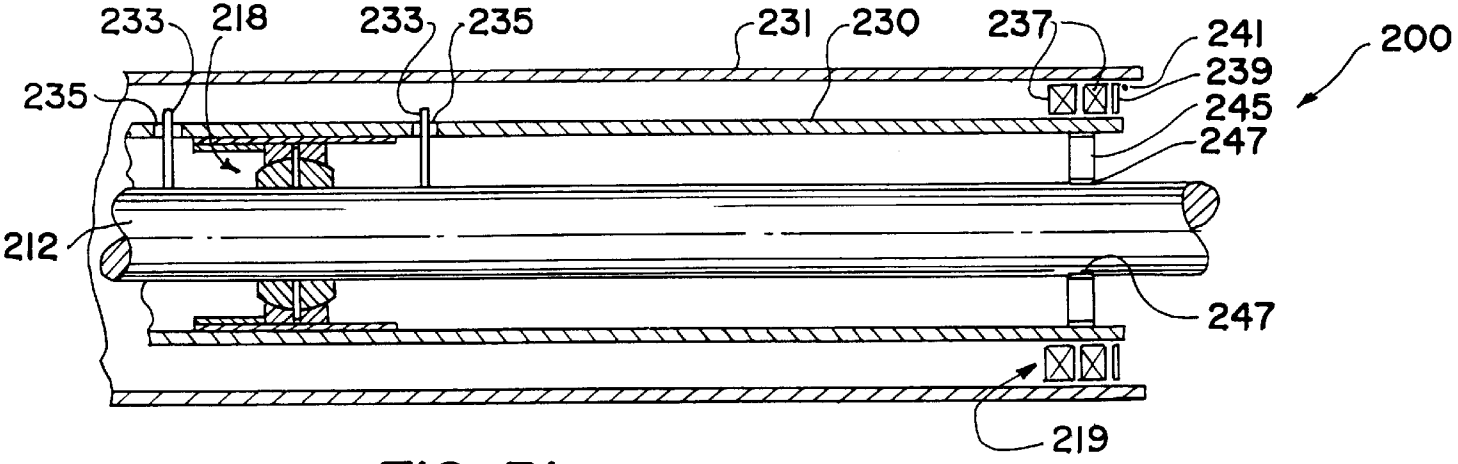
FIG. 31 is a partial cutaway sectional view of FIG. 30 showing the center pivoting bearing having locking pins on each side thereof to prevent rotation between the shaft and pivoting sleeve, and showing the pliable distal end bushing and distal end rotary bearings.

As shown in FIG. 28, the tracking assembly 100 is utilized as an end roller. Note that the adjustable control arms 102 are positioned to respond to the top of the web of material. The adjustable arms 102 are mounted according to the direction of the material 116.

Double Equalizing Roll

With reference to FIGS. 30–38, the double equalizer roll 200 provides an alternate embodiment for high speed operations such as in paper printing processes. The design of the double equalizer roll 200 utilizes a pivoting center bearing 218 which pivots but does not rotate around the shaft 212 in corporative engagement with a pivoting sleeve 230. The double equalizer roll 200 utilizes a pair of nonpivoting rotary bearings 219 for connecting the pivoting sleeve 230 to an outer coaxial rotary sleeve 231. The double equalizer roll 200 is very effective at high speed operations in minimizing vibration and providing additional rotational stability, especially in applications wherein the weight and/or width of the web changes dramatically where rapid response is required to compensate in the conveying process.

More particularly, the double equalizing roll 200 utilizes a stationary shaft 212 mounted horizontally on clamped rigid supports 217 preventing rotation. Mounted in the center of the shaft 212 is a pivoting bearing 218 disposed within and cooperatively engaging a pivoting sleeve 230. The pivoting bearing 218 may be a rotary type bearing; however, the pivoting sleeve 230 and pivoting bearing 218 are prevented from rotating around the shaft 212 by means for locking such as at least one locking pin 233 drilled and tapped in to the shaft 212 and extending normal therefrom and through at least a portion of the pivoting sleeve 230. As shown in FIGS. 30–31, 33–34, and 37–38, the preferred embodiments utilize a pair of locking pins 233, one on each side of the pivoting bearing 218 in order to maintain the roll balance around the center point of the pivoting bearing 218. Each locking pin 233 extends at least partially through a slot 235 formed in the pivoting sleeve 230. The slot 235 is of sufficient length and width to accommodate the shifting of the locking pin 233 upon pivoting of the roll "up and down", "back and forth", and in an circular motion thereinbetween. The pivoting bearing assembly 218 is centrally mounted inside the pivoting sleeve 230 formed from a hollow cylinder or roll of metal preferably stainless steel and machined to be in balance with respect to the centrally disposed pivoting bearing assembly 218. The mating of the concave and convex portions of the pivoting bearing assembly 218 permits a selected degree of lateral rotation in a range of from about 1 degree to about 10 degrees. The stationary shaft 212 and pivoting sleeve 230 are placed coaxially within a rotating sleeve 231 having a greater diameter than the pivoting sleeve 230. The rotating sleeve 230 is mounted in cooperative rotating engagement with the pivoting sleeve 230 by at least two nonpivoting rotary bearings 237 disposed thereinbetween on each side of pivoting bearing assembly 218. As the web runs over the rotary sleeve 231, any imbalance of lateral tension will cause the pivoting sleeve 230 to pivot at it's center with respect to the longitudinal axis of the shaft 212 permitting the pivoting sleeve 230 to move upward on the side of least tension until the web tension is equalized across the pivoting sleeve 230 while the exterior rotary sleeve 231 rotates about the pivoting sleeve 230.

Figure 35:
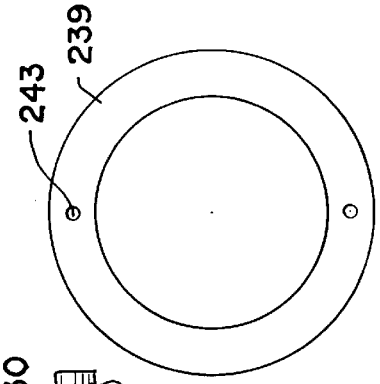
FIG. 35 shows an end view of the ring which covers the rotary bearings and is disposed on the exterior thereof between the rotary sleeve and the pivoting sleeve, wherein the ring includes a pair of holes therethrough providing a means of lubricating the rotary bearings through grease zerts in close proximity thereto for the double equalizer roll.
Figure 36:
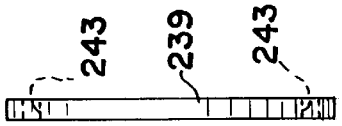
FIG. 36 is a side view of the retainer ring of FIG. 35.

As shown in FIGS. 30–38, best shown in FIGS. 35–36, a retaining ring 239 is positioned on the outer surface of the rotary bearings 237 and held into position with a retaining spring clip 241. The retaining ring 239 may have one or more holes 243 therethrough providing easy access to grease zerts for lubrication of rotary bearings 231. Moreover, the pivoting sleeve 230 and/or the rotary sleeve 233 may have recessed portions machined therein to accommodate the rotary bearings 237 and fine grooves 243 providing seating for the retaining spring clips or snap rings 241.

Use of the pivoting sleeve 230 in combination with the rotary sleeve 231 provides a means for compensating for the tension and weight distribution of the web for high speed operations and minimize maintenance due to wear on the pivoting bearing assembly 218. Furthermore, lubrication and replacement of the pivoting bearing assembly 218 is reduced and replacement of the rotary sleeve 231 is easy and fast.

Figure 32:
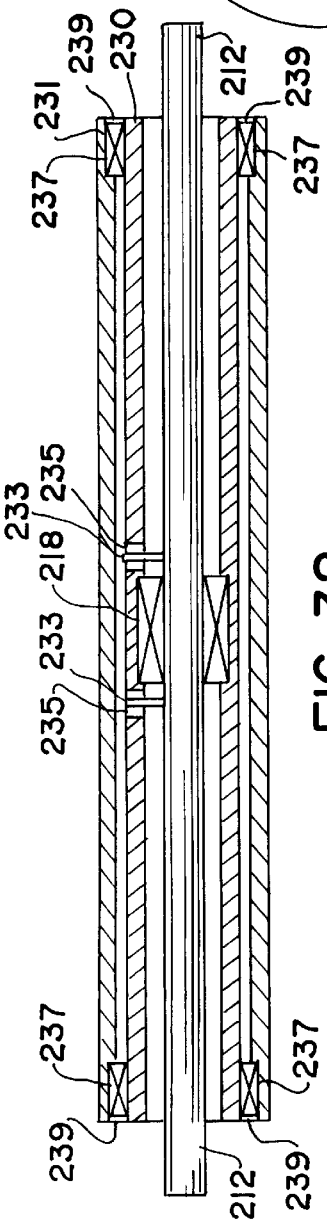
FIG. 32 is a schematic view showing the shaft of the double equalizer roll having a pivoting sleeve and rotating sleeve positioned coaxially around one another with respect to the center pivoting bearing and distal end rotary bearings.
Figure 33:
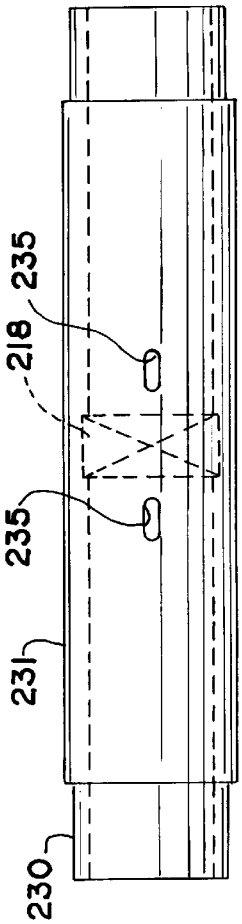
FIG. 33 is a top view of the double equalizer roll showing the rotary sleeve coaxially positioned around the pivoting sleeve and a pair of slots formed through the pivoting sleeve allowing pivoting motion of a pair of locking pins extending therethrough on each side of the center pivoting bearing preventing rotation between the shaft and pivoting sleeve.
Figure 34:
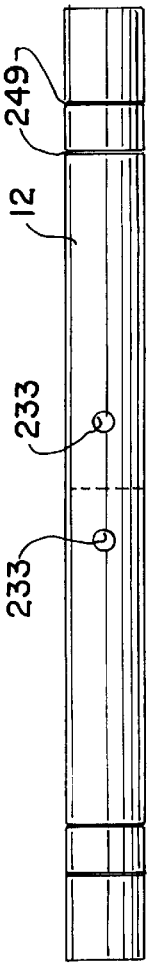
FIG. 34 shows a pair of locking pins extending on each side of the center point of the nonrotating shaft of the double equalizer roll.

The double equalizing roll 200 as shown in FIG. 32 shows that the pivoting sleeve 230 and rotary sleeve 231 are balanced on the pivoting bearing 218 and do not touch the shaft 212 when pivoting during operation. Depending upon the length of the double equalizing roll 200 and the weight and width of the web, the distal ends 214 of the nonrotating shaft 212 may sometimes touch the nonrotating pivoting sleeve 230. Pliable foam bushings 245 are optionally used as a dampening and cushioning means being disposed coaxially around the shaft 212 and between the pivoting sleeve 230 at or near the distal end thereof to absorb shock and vibrations. A depression 247 may be machined into the shaft 212 having a width to accommodate the width of the foam bushings 245, or alternately thin grooves 249 may hold the foam bushings in place by a friction fit or accommodate snap rings.

Figure 37:
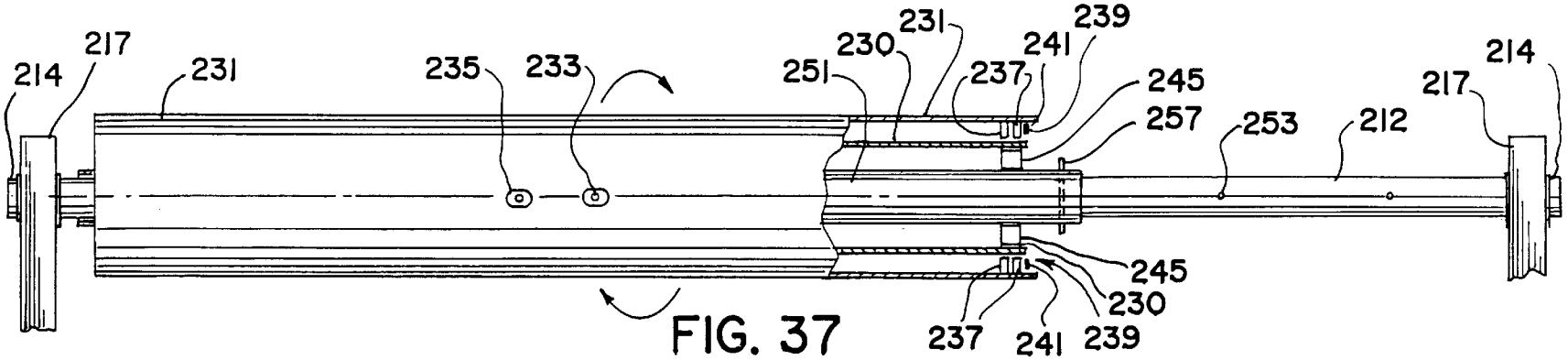
FIG. 37 is a front partial cutaway view showing the double equalizing roll showing the rotating sleeve supported by a pair of distal end rotary bearings extending coaxially around the nonrotating pivoting sleeve supported by a pivoting bearing extending coaxially around an shaft sleeve, wherein the shaft sleeve is movable along the longitudinal axis of a nonrotating shaft, whereby the shaft sleeve is connected to the nonrotating shaft and the nonrotating pivoting sleeve which has a pliable distal end bushing extending therearound between the shaft sleeve and the pivoting sleeve.
Figure 38:
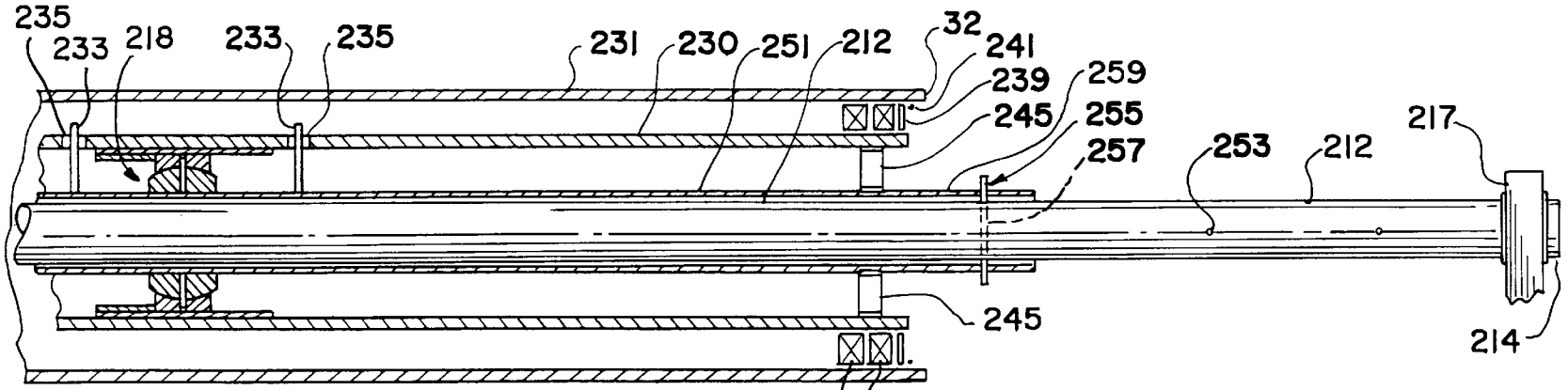
FIG. 38 is a partial cutaway sectional view of FIG. 30 showing the center pivoting bearing having locking pins on each side thereof to prevent rotation between the shaft, shaft sleeve, and pivoting sleeve, and showing the pliable distal end bushing and distal end rotary bearings.

As best illustrated in FIGS. 37–38, the double equalizing roll 200 is modified by the addition of a shaft sleeve 251 extending coaxially around a nonrotating shaft 212. The pivoting bearing assembly 218 is coaxially connected to the shaft sleeve 251 in the same manner as described heretofore. At nonrotating shaft 212 includes at least one hole 253 therethrough at various intervals on the longitudinal axis which correspond to holes 255 formed through the nonrotating shaft sleeve 251. A means for locking such as a locking pin 257 is used to prevent rotation of the shaft sleeve 251 around the shaft 212. Optionally, a foam bushing 245 may be disposed coaxialy around the shaft sleeve 251 and the pivoting sleeve 230. The shaft sleeve 251 may be machined to create a recess 259 adapted for holding the foam bushing 245 in position.

The use of the shaft sleeve 251 provides a means for sliding the double equalizer roll 200 along a shaft 212 to position the roll 200 in accordance with the position of web feeding off of a conveyor roller. For instance, in the paper industry, a full web may extend across the entire roll 200. If the web is cut back for some reason, the web producer may run a ½ web or ¼ web; therefor, the double equalizer roll 200 can be positioned by sliding along the shaft 212 in order that the web be centered thereon.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. An equalizer roll for controlling web tension, comprising:

a nonrotating shaft;

means for supporting said shaft;

a pivoting bearing disposed coaxially around said shaft;

a pivoting sleeve extending coaxially around said shaft mounted in cooperative engagement with said pivoting bearing, said pivoting sleeve being balanced at its weighted center;

means for preventing rotation of said pivoting sleeve and said pivoting bearing around said shaft; and a rotary sleeve extending coaxially around said pivoting sleeve rotatably mounted thereto by at least one rotary bearing positioned on each side of said pivoting bearing, each one of said rotary bearings extending coaxially around said pivoting sleeve being in cooperative engagement with said rotary sleeve.

* * * * *